US006082730A

United States Patent [19]

Campbell et al.

[11] Patent Number: 6,082,730

[45] Date of Patent: Jul. 4, 2000

[54] INTEGRATED LONG SHEET FEEDER

[75] Inventors: Michael Clark Campbell; Christopher Patrick Murphy; Thomas Eugene Pangburn; Michael Shayne Wilson, all of Lexington, Ky.

[73] Assignee: Lexmark International, Inc., Lexington, Ky.

[21] Appl. No.: 09/162,842

[22] Filed: Sep. 29, 1998

[51] Int. Cl.[7] ..... B65H 1/00

[52] U.S. Cl. ..... 271/171

[58] Field of Search ..... 271/145, 162, 271/167, 171; 347/4, 16, 104, 105; 400/613.2

[56] References Cited

U.S. PATENT DOCUMENTS

| | | | |
|---|---|---|---|
| 2,104,484 | 1/1938 | Janney | 197/133 |
| 3,995,847 | 12/1976 | Schiff | 270/58 |
| 4,619,388 | 10/1986 | Ono et al. | 226/76 |
| 4,635,916 | 1/1987 | Modugno et al. | 271/171 X |
| 4,674,899 | 6/1987 | Kimura | 400/605 |
| 4,711,442 | 12/1987 | Rünzi | 271/22 |
| 4,871,273 | 10/1989 | Fields | 400/613.2 |
| 4,968,016 | 11/1990 | Koyama | 271/9 |
| 5,059,049 | 10/1991 | Rosenthal | 400/605 |
| 5,092,690 | 3/1992 | Grimm et al. | 400/126 |
| 5,141,346 | 8/1992 | Nakagawa | 400/605 |
| 5,152,623 | 10/1992 | Yamada et al. | 400/605 |
| 5,172,238 | 12/1992 | Kuboki | 358/296 |
| 5,172,903 | 12/1992 | Haneda et al. | 271/171 |
| 5,276,527 | 1/1994 | Sugiyama et al. | 358/296 |
| 5,358,345 | 10/1994 | Damitio | 400/613.2 |
| 5,437,444 | 8/1995 | Kawakami et al. | 271/22 |
| 5,454,555 | 10/1995 | Kiyohara et al. | 271/9 |

FOREIGN PATENT DOCUMENTS

| | | | |
|---|---|---|---|
| 63-315425 | 12/1988 | Japan | 271/171 |

*Primary Examiner*—David H. Bollinger
*Attorney, Agent, or Firm*—John A. Brady

[57] ABSTRACT

Printer (1) has a large paper support tray (7) on one side, which is rotated outward to feed continuous forms (9). The length of tray 7 is extended by moving outward extension 7*a*. Tray 7 is folded into printer 1 when not in use.

9 Claims, 3 Drawing Sheets

INTEGRATED LONG SHEET FEEDER

TECHNICAL FIELD OF THE INVENTION

This invention related to printers having the capability of feeding and printing on an exceptionally long sheet, sometimes termed banner printing.

BACKGROUND OF THE INVENTION

The Lexmark 1000 inkjet printer first sold publicly in July 1997, has a device which allows the feeding of continuous forms from elements from which discrete sheets are normally fed. This device required the removal, rotation, and reinsertion of a paper support. After this, a second component (a continuous form support) was required to be attached to the paper support in order for it to properly feed continuous form paper. This required a user of the inkjet printer to separately store the continuous form support until it was needed for feeding continuous form paper. Also, the removal and rotation of the continuous form support is somewhat awkward for users.

This invention integrates a separate support into the printer to permit the features of banner printing to be readily and easily accessible to the operator of the printer.

DISCLOSURE OF THE INVENTION

By integrating a special continuous form feeding device into a recessed area of an inkjet printer, continuous form paper can be fed through the printer without requiring the removal of parts. The integrated feeding device is unfolded from the rear of the printer for use during continuous form paper feeding, then restored to its closed and recessed position when not in use. The design of this system allows paper to be fed over the top of and through existing automatic sheet feed mechanisms on inkjet printers, as well as other devices using similar automatic discrete sheet feed devices, much as done by the 1000 inkjet printer discussed in the foregoing.

The support has a built-in sliding floor which is simply pulled out to lengthen the support to the required length. At least one wall on the sides or at the end of the sliding floor contact the continuous paper as a resistance to the body of paper moving upward during feeding instead of single sheets unfolding. Alternatively, the sliding floor may be replaced by a removable member attached to the support.

DESCRIPTION OF THE PREFERRED EMBODIMENTS

The details of this invention will be described in connection with the accompanying drawings, in which.

DESCRIPTION OF THE PREFERRED EMBODIMENTS

Figure 1:
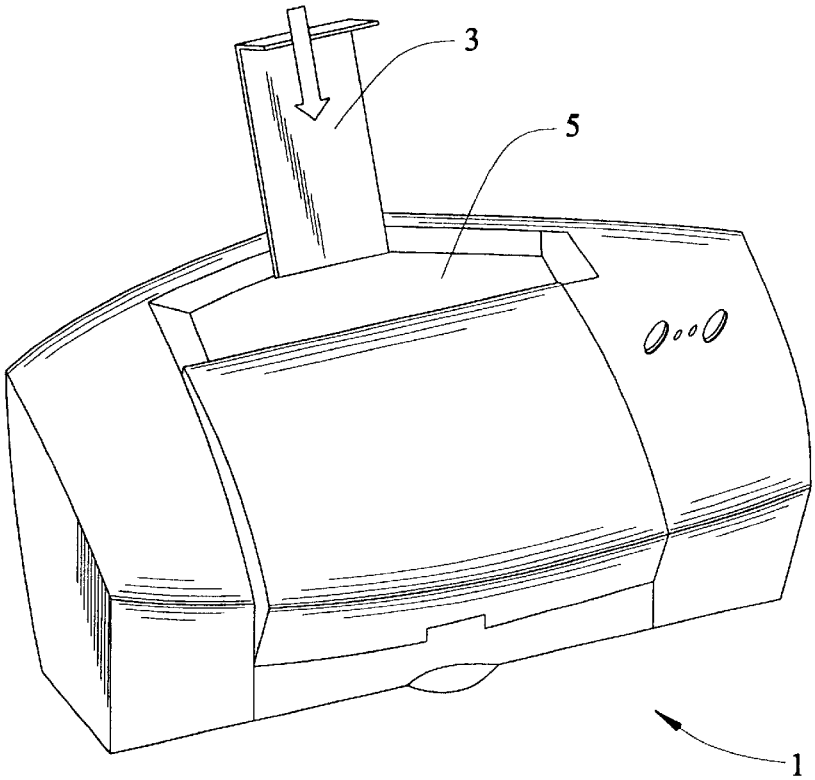
FIG. 1 is a front view of a printer having this invention with the normal sheet feed support in the outward position.
Figure 2:
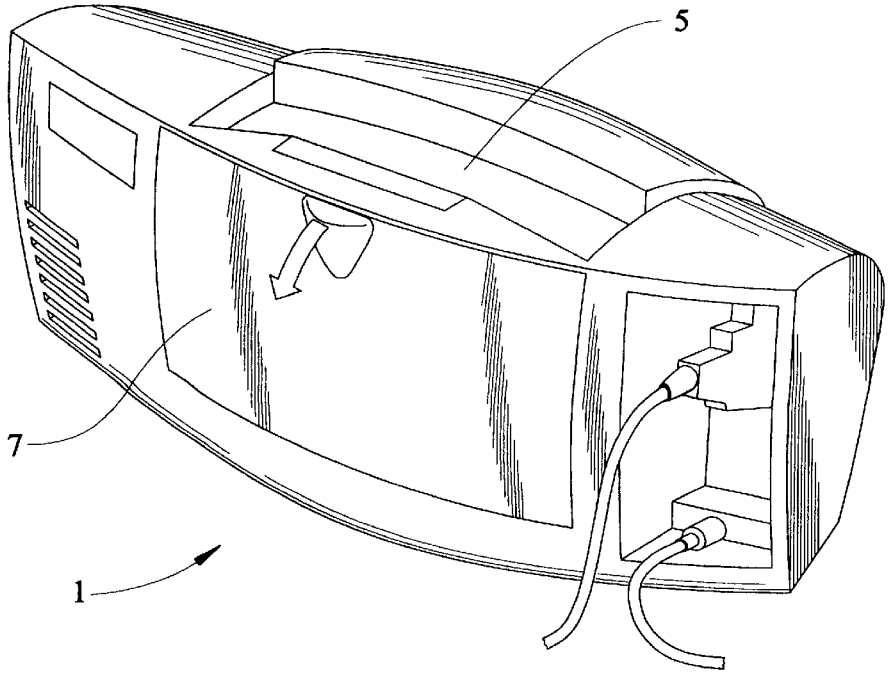
FIG. 2 is a rear view of the printer with the banner support in the closed, storage position.
Figure 3:
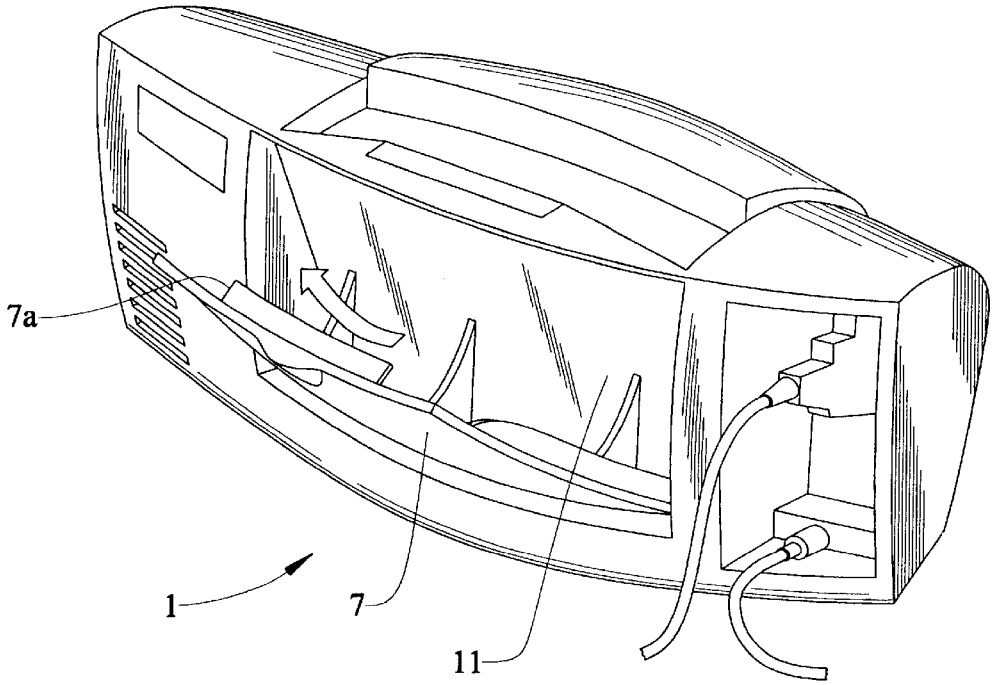
FIG. 3 is a rear view of the printer with the banner support in its open position and the extension not yet pulled out.
Figure 4:
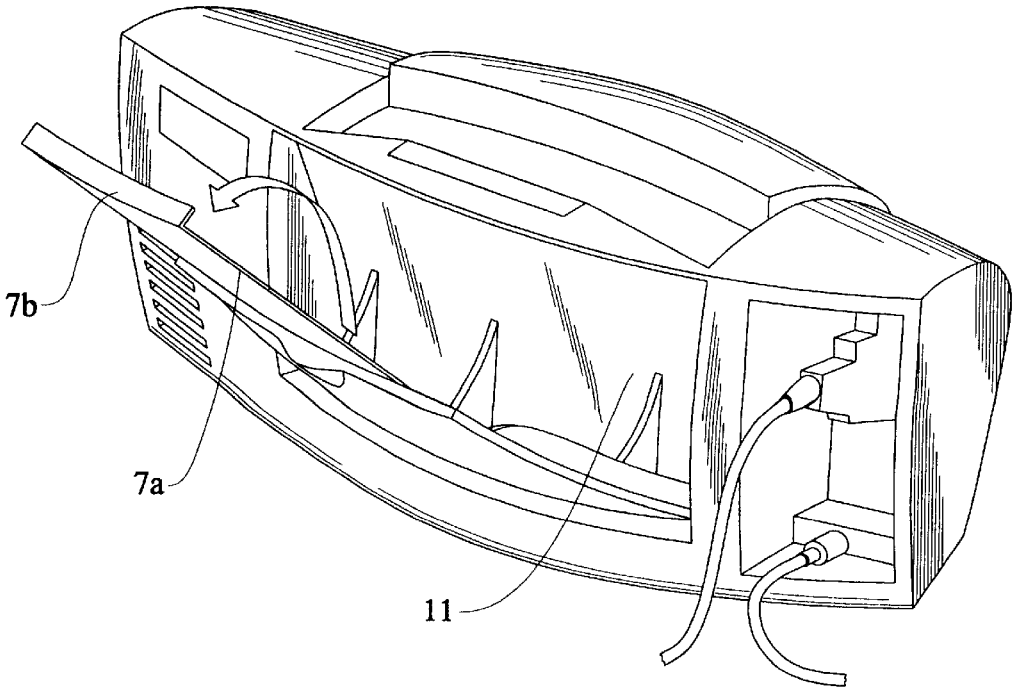
FIG. 4 is a rear view of the printer with the extension in its operative, outward position.

This integrated device to feed continuous form paper in an inkjet printer utilizes a specially designed continuous form feeder that is attached to the rear cover of the printer 1. This device, when not in use, is rotated to a concealed position in the rear cover of the printer 1. A form support element 7 is connected to the back of the printer 1 by lower hinges (not shown). When an inkjet printer user desires to print using continuous forms, the user lowers the paper support 3 in the sheet feeder 5 (FIG. 1). The user rotates the form support 7 outward to the continuous form feeding position (FIG. 3). A sliding support extender 7*a* is then extended which will give support to the full length of a folded continuous form paper during feeding (FIG. 4).

The extender 7*a* also has an end wall 7*b* to hold the continuous form paper 9 in proper feeding position as the stack of paper 9 is unfolded. This is required because the paper 9 as a whole can be pulled out of the feeder 7 when there are only a few pages left to feed. This is caused by upward forces on the paper 9 during feeding that can pull the stack out when there are only a few pages due to its lighter weight. To prevent this end wall 7*b* contacts the paper 9 with sufficient friction to act as a retaining surface. (Preventing paper from being pulled out of the feeder can also be accomplished by adding high friction surfaces elsewhere on the continuous form paper feeder that will prevent the paper from sliding up.)

Figure 5:
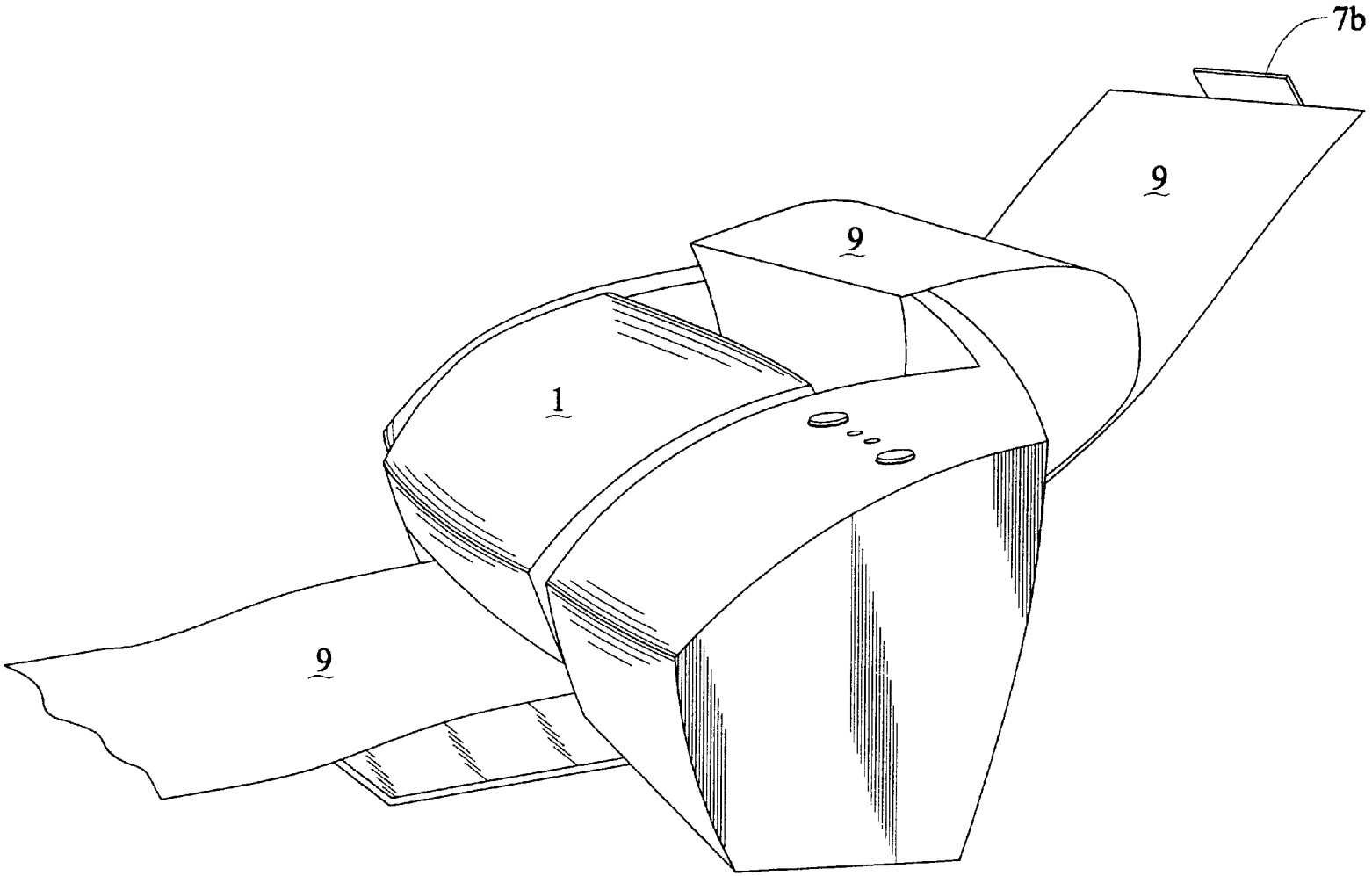
FIG. 5 shows the printer in operation printing an exceptionally long sheet of paper (a banner).

Once the continuous form feeding device is in its feeding position (FIG. 4), continuous form paper 9 is loaded (FIG. 5). The paper is held by resting on the continuous form feeder device 7, and it is routed over the top of the standard sheet feeder such that the continuous form paper follows the same paper path through the printer as standard paper (FIG. 5). An alternative to going over the top of a standard sheet feeder would be to provide an opening for the continuous form paper to go through the lower portion of the sheet feeder 5. This would allow a simple path to the feed rollers of a printer or similar machine using continuous form paper.

A flat main body of extender 7*a* is captured in slots (not shown) in support 7. It is held in place by friction and slides in and out readily by human pushing and pulling which overcomes the friction. Such extenders in paper supports are highly conventional and so will not be further described.

It will be noted that the feed mechanism of printer 1 is at the top of printer 1 and that the recess 11 into which support 7 folds need have no other function nor contain an opening into any sheet feed or other mechanism. Accordingly, virtually any printer can accommodate this invention by only adding the hinged support 7 to the back of the printer. The hinges may be of any standard configuration, such as molded pins on each side of support 7 which fit in corresponding holes of printer 1 after being inserted by flexing support 7. Similarly, a standard, flexible detent (not shown) on the top of support 7 holds support 7 after it is closed.

It will be further noted that many of the advantages of this invention can be realized even if extension 7*a* is not incorporated into support 7, but is attached as a separate member. In particular, the location and positioning of support 7 can be ideally placed in accordance with this invention, as they are not directly dependent on other mechanisms of the printer 1.

Accordingly, patent coverage as provided by law is sought, with particular reference to the accompanying claims.

We claim:

1. A printer having external sides and a sheet feed opening to receive sheets for printing, a pivoted sheet support member mounted on one of said sides, and an extension member to be supported by said support member in one position, said one position adding to the length of said support member to form an extended surface to support sheets, said support member being separated from said sheet feed opening whereby a continuous sheet folded in a stack supported on said support member and said extended surface can be fed upward off the top of said stack through said sheet feed opening.

2. The printer as claim 1 in which at least one of said support member and said extension member have a wall to contact a side of a stack of folded, continuous sheets to resist movement of said sheets as a body so that said stack moves by unfolding.

3. The printer as in claim 2 in which said wall to contact a side of a stack is on the outer end of said extension member.

4. The printer as in claim 1 in which said extension member is removably mounted on said support.

5. The printer as in claim 2 in which said extension member is removably mounted on said support.

6. The printer as in claim 3 in which said extension member is removably mounted on said support.

7. The printer as in claim 1 in which said extension member is slidably mounted on said support.

8. The printer as in claim 2 in which said extension member is slidably mounted on said support.

9. The printer as in claim 3 in which said extension member is slidably mounted on said support.

* * * * *